US010815641B2

(12) United States Patent
Boyd

(10) Patent No.: US 10,815,641 B2
(45) Date of Patent: Oct. 27, 2020

(54) FRONT LOADER AND WORKING MACHINE

(71) Applicant: Kubota Corporation, Osaka-shi (JP)

(72) Inventor: Robert Stewart Boyd, Jefferson, GA (US)

(73) Assignee: Kubota Corporation, Osaka (JP)

( * ) Notice: Subject to any disclaimer, the term of this patent is extended or adjusted under 35 U.S.C. 154(b) by 0 days.

(21) Appl. No.: 16/443,222

(22) Filed: Jun. 17, 2019

(65) Prior Publication Data

US 2019/0301128 A1 Oct. 3, 2019

Related U.S. Application Data

(63) Continuation of application No. 16/010,943, filed on Jun. 18, 2018, now Pat. No. 10,370,819, which is a continuation of application No. 15/855,096, filed on Dec. 27, 2017, now Pat. No. 10,036,138.

(51) Int. Cl.
*E02F 3/627* (2006.01)
*E02F 3/34* (2006.01)

(52) U.S. Cl.
CPC ..... *E02F 3/6273* (2013.01); *E02F 3/34* (2013.01)

(58) Field of Classification Search
CPC ..... E02F 3/34; E02F 3/36; E02F 3/422; E02F 3/432; E02F 3/433; E02F 3/6273; E02F 3/968
USPC ..... 37/444; 414/686
See application file for complete search history.

(56) References Cited

U.S. PATENT DOCUMENTS

| | | | | |
|---|---|---|---|---|
| 4,264,264 | A * | 4/1981 | McMillan | E02F 3/968 37/403 |
| 4,347,031 | A | 8/1982 | Friesen et al. | |
| 4,522,554 | A | 6/1985 | Williams et al. | |
| 4,825,568 | A * | 5/1989 | Kawamura | E02F 3/432 172/274 |
| 4,936,737 | A | 6/1990 | Rae et al. | |
| 5,129,780 | A | 7/1992 | Stumpe | |
| 5,405,237 | A * | 4/1995 | Oka | B66F 9/065 414/685 |
| 5,540,289 | A | 7/1996 | Hirooka et al. | |
| 7,281,890 | B2 | 10/2007 | Friesen et al. | |
| 7,568,878 | B2 * | 8/2009 | Frey | E02F 3/432 414/686 |
| D656,523 | S * | 3/2012 | Nilsson | D15/28 |
| D766,343 | S * | 9/2016 | Linan | D15/28 |
| 2005/0111953 | A1 | 5/2005 | Westendorf et al. | |
| 2006/0245899 | A1 | 11/2006 | Lyons et al. | |
| 2007/0020078 | A1 * | 1/2007 | Frey | E02F 3/38 414/686 |
| 2010/0095563 | A1 | 4/2010 | Webb et al. | |

(Continued)

FOREIGN PATENT DOCUMENTS

| | | | | |
|---|---|---|---|---|
| DE | 2928278 A1 | 1/1981 | | |
| JP | 01033323 A * | 2/1989 | | E02F 3/968 |

(Continued)

*Primary Examiner* — Saul Rodriguez
*Assistant Examiner* — Brendan P Tighe
(74) *Attorney, Agent, or Firm* — The Webb Law Firm

(57) ABSTRACT

A link operating mechanism is provided spanning a bucket and a stand. The link operating mechanism causes, using a swing force of the bucket, a bending/stretching link to bend so that propping and supporting of the bending/stretching link are released.

14 Claims, 9 Drawing Sheets

(56) References Cited

U.S. PATENT DOCUMENTS

| | | | | |
|---|---|---|---|---|
| 2011/0318154 | A1* | 12/2011 | Faivre | E02F 3/6273<br>414/685 |
| 2017/0114517 | A1 | 4/2017 | Mori et al. | |
| 2017/0247854 | A1 | 8/2017 | Hyder | |

FOREIGN PATENT DOCUMENTS

| | | | | |
|---|---|---|---|---|
| JP | 3452089 | B2 * | 9/2003 | F16L 37/56 |
| JP | 3616408 | B2 * | 2/2005 | E02F 3/3654 |
| JP | 3842470 | B2 * | 11/2006 | E02F 3/6273 |
| JP | 4233530 | B2 * | 3/2009 | E02F 3/6273 |
| JP | 201684617 | A | 5/2016 | |

* cited by examiner

Fig.3
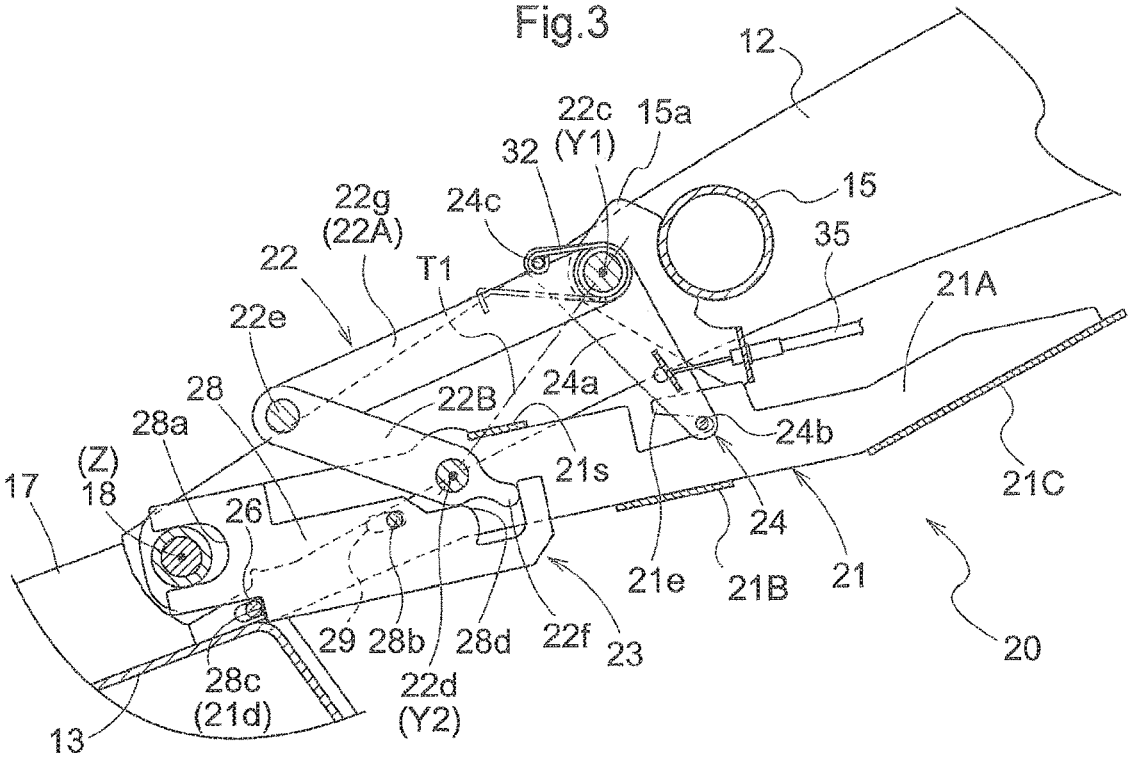
Fig.4
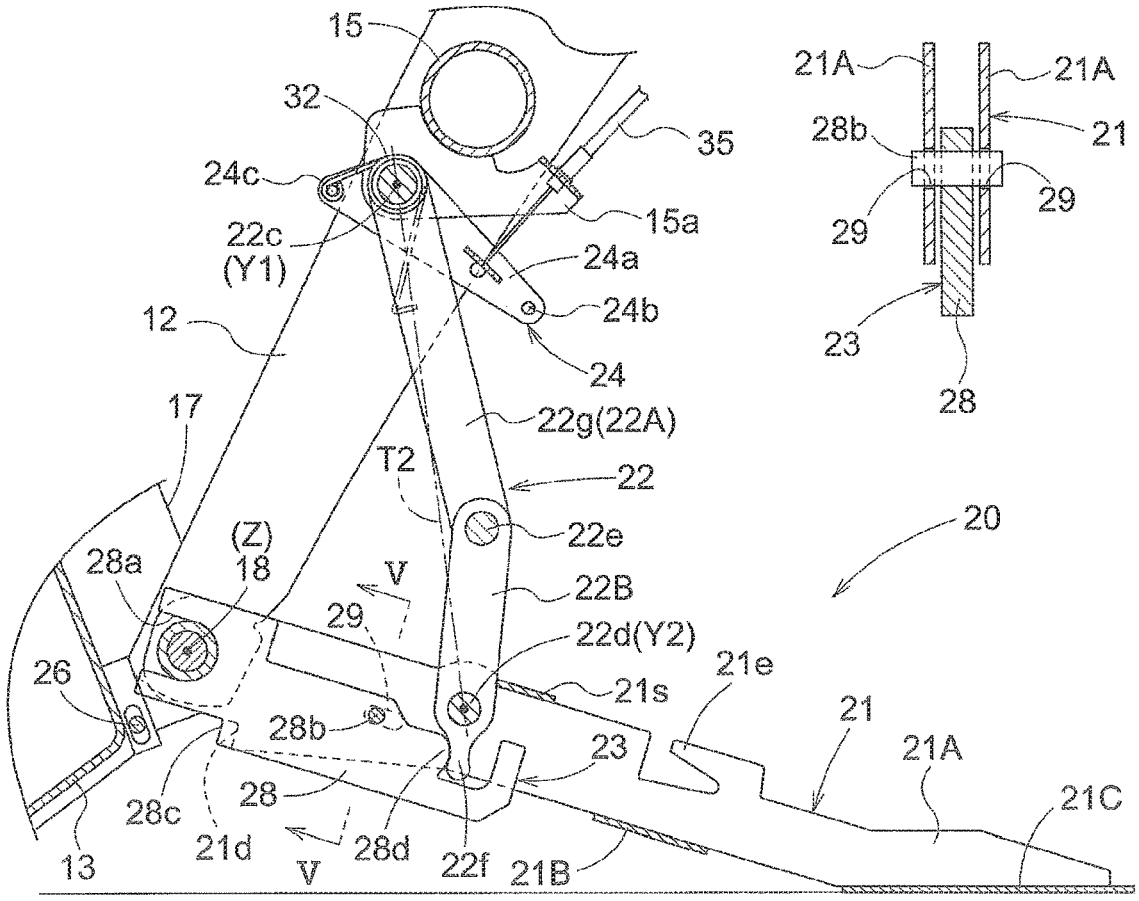
Fig.5

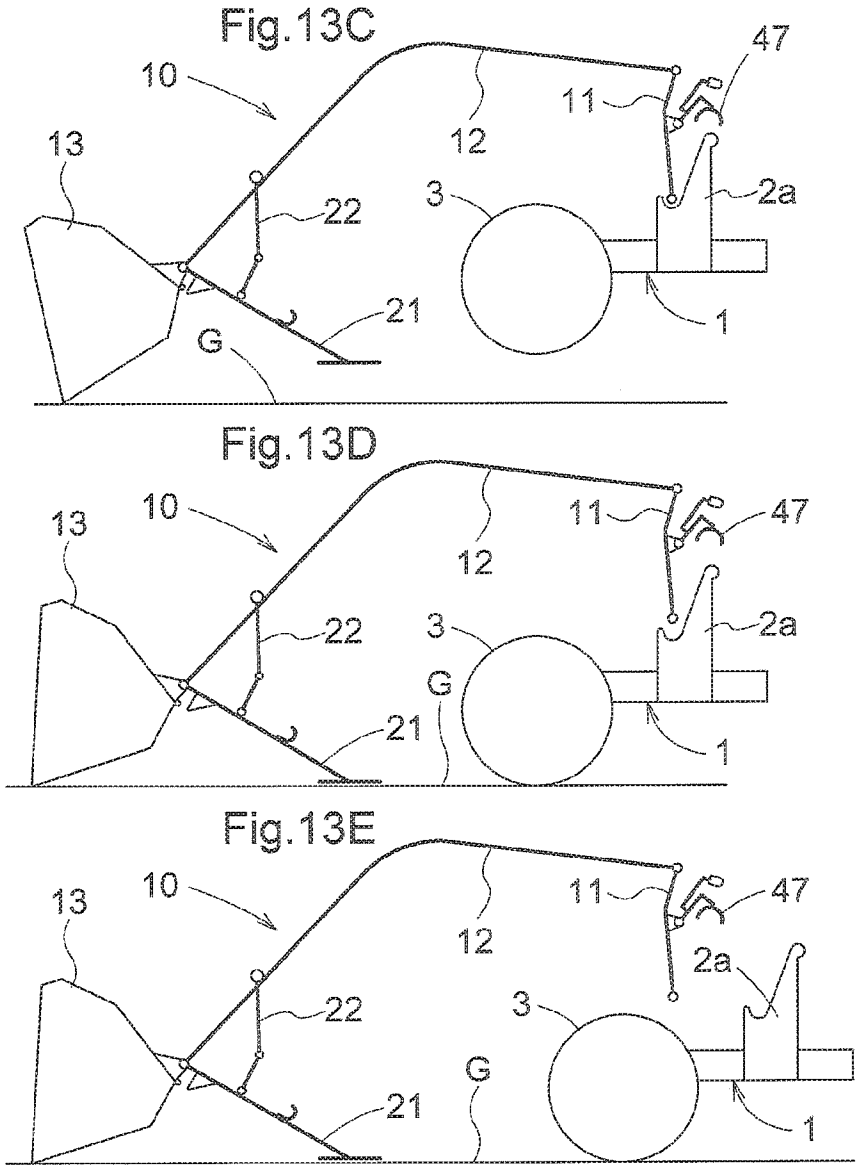
Fig.13C
Fig.13D
Fig.13E
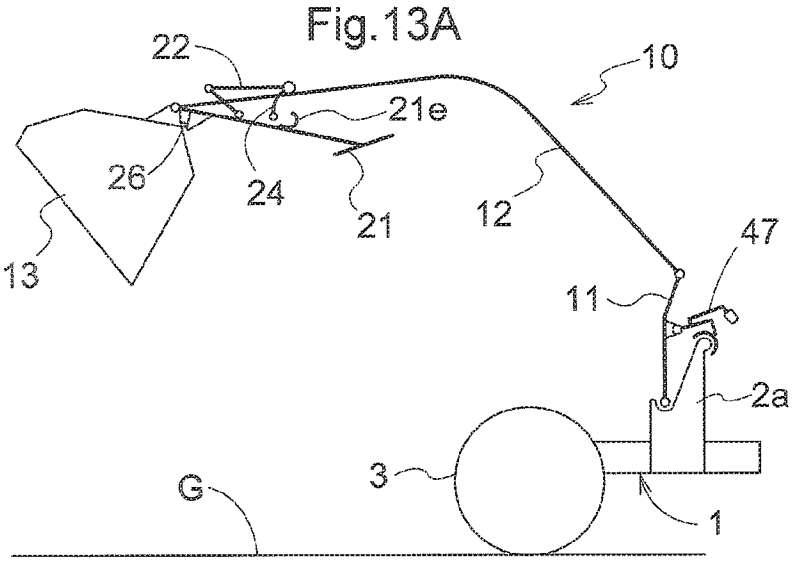
Fig.13A
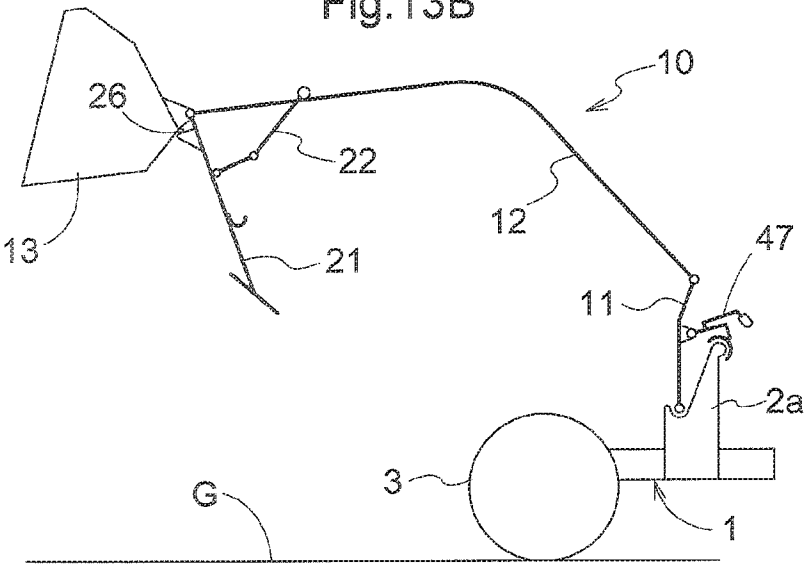
Fig.13B

FRONT LOADER AND WORKING MACHINE

CROSS REFERENCE TO RELATED APPLICATION

This application is a continuation of U.S. patent application Ser. No. 16/010,943 filed Jun. 18, 2018, which is a continuation of U.S. patent application Ser. No. 15/855,096 filed Dec. 27, 2017, the disclosures of each of which are hereby incorporated by reference in their entirety herein.

BACKGROUND OF THE INVENTION

Field of the Invention

The present invention is directed to a front loader and a working machine provided with the front loader.

Description of Related Art

As front loaders, there are ones including: a boom removably coupled to a vehicle body; a bucket supported at a front end of the boom; a stand that supports the boom, when removed from the vehicle body, in a state in which the bucket is engaged on the ground; and a support link that is provided spanning the boom and the stand, and is configured to prop and support the stand in the grounded state.

For example, U.S. Pat. No. 4,347,031 discloses a front loader of this type. The front loader disclosed in U.S. Pat. No. 4,347,031 includes a stand body serving as the stand, and a slide mechanism.

SUMMARY OF THE INVENTION

The stand is required to be stored more compactly so as not to obstruct loader operations. Accordingly, for example, when the front loader is coupled to the vehicle body using a conventional technology and performs loader operations, the stand is folded to be compact using a conventional technology and stored. To fold the stand to be compact, using a bending/stretching link as the support link has also been considered, but there may be cases where the bending/stretching link is unlikely to bend due to strong bending resistance, and thus there is the risk that it will take time to store the stand.

The present invention provides a front loader and a working machine in which a stand can be raised smoothly with a simple structure even if a bending/stretching link has strong bending resistance.

According to the present invention, the front loader includes: a boom configured to be removably coupled to a vehicle body;

a bucket supported at a front end of the boom;

a stand configured to support the boom, when removed from the vehicle body, in a state in which the bucket is engaged on the ground;

a bending/stretching link that is provided spanning the boom and the stand, and is configured to prop and support the stand in a state in which the stand is engaged on the ground; and a link operating mechanism that is provided spanning the bucket and the stand, and is configured to cause, using a swing force of the bucket, the bending/stretching link to bend so that the propping and supporting of the bending/stretching link are released.

According to the present configuration, even if the bending/stretching link has strong bending resistance, the bending/stretching link is forcibly caused to bend by the link operating mechanism so that the propping and supporting are released, and thus it is easy for the bending/stretching link to bend compared to a case where it is bent only by the ascending force of the stand, and thus it is possible to smoothly raise the stand.

Since the swing force of the bucket is used as a power source of the link operating mechanism, the structure of the link operating mechanism can be simplified.

According to the present invention, preferably, the link operating mechanism includes a link operating member slidably supported on the stand, the link operating member being configured to abut and press against a lower portion of the bending/stretching link to release the propping and supporting of the bending/stretching link.

According to the present configuration, since the link operating member slides relative to the stand to operate the bending/stretching link so that the propping and supporting thereof is released, it is possible to smoothly release the propping and supporting of the bending/stretching link. Furthermore, it is possible to achieve a link operating mechanism with a simpler structure in which the link operating member is slidably supported on the stand.

According to the present invention, preferably, the stand includes a pair of left and right longitudinal plate portions, and the link operating member is arranged between the pair of left and right longitudinal plate portions.

According to the present configuration, with a simple guard structure in which the left and right longitudinal plate portions are used as guard members for the link operating member, it is possible to protect the link operating member from colliding with a stone or the like.

According to the present invention, preferably, a holding member whose posture can be changed between a holding posture in which the holding member is engaged with the stand to hold the stand at a raised/stored position, and a releasing posture in which the holding member is disengaged from the stand; and an operation tool that is operably coupled to the holding member, the operation tool being operated by an operator to be at a locked position to change the posture of the holding member to the holding posture, and being operated by the operator to be at an unlocked position to change the posture of the holding member to the releasing posture are provided.

According to the present configuration, it is possible to perform loader operations such that the stand is held at the raised/stored position by the holding member while preventing the stand from being damaged due to falling, for example. Furthermore, it is convenient that the holding member can be operated remotely using the operation tool.

According to the present invention, preferably, an operation tool lock configured to be switchable between a locking state of holding the operation tool at the locked position, and an unlocking state of releasing holding of the operation tool at the locked position is provided.

As a result of the operation tool being held at the locked position by the operation tool lock, the holding member is held in the holding posture, and thus it is possible to reliably hold the stand at the raised/stored position.

According to the present invention, preferably, an operation portion of the operation tool is provided with an unlock operation tool configured to switch the operation tool lock to the unlocking state.

According to the present configuration, an operator can operate the unlock operation tool, using his or her hand that holds the operation portion, to unlock the operation tool locked at the locked position by the operation tool lock, and thus the operator can smoothly switch the operation tool to the unlocked position without changing their grip between the operation portion and the unlock operation tool, and can rapidly switch the holding member to the releasing posture.

According to the present invention, preferably, the operation portion is a grip arm, and the unlock operation tool is configured to be gripped together with the operation portion.

According to the present configuration, an operator can perform operation while gripping the operation portion and the unlock operation tool together, and thus can more smoothly perform the operation of unlocking the operation tool locked at the locked position by the operation tool lock, and switching the operation tool to the unlocked position.

According to the present invention, preferably, an elastic member configured to bias the holding member to the releasing posture is provided.

According to the present configuration, since the holding member is reliably held in the releasing posture by the elastic member, it is easy to lower the stand while preventing it from catching on the holding member.

According to the present invention, preferably, the holding member and the operation tool are operably coupled to each other via a wire.

With the simple coupling and cooperation structure including a wire, the holding member and the operation tool can be operably coupled to each other.

According to the present invention, preferably, the boom includes a left boom coupled to a left lateral side portion of the vehicle body, and a right boom coupled to a right lateral side portion of the vehicle body; the stand includes a left stand supported on the left boom, and a right stand supported by the right boom; and the holding member includes a left stand holding plate that acts on the left stand, and a right stand holding plate that acts on the right stand, the left stand holding plate and the right stand holding plate being coupled to and cooperating with the operation tool.

According to the present configuration, it is convenient that the left stand holding plate and the right stand holding plate can be switched at once using the operation tool common to both holding members.

According to the present invention, preferably, a left wire configured to operably couple the left holding member to the operation tool; and a right wire configured to operably couple the right holding member to the operation tool are provided, wherein a position of the operation tool to which the left wire is coupled and a position of the operation tool to which the right wire is coupled can be changed and adjusted separately.

Both of the left stand holding plate and the right stand holding plate are subjected to posture change using the operation tool common to the two holding members, and positions of the operation tool to which the left wire and the right wire are coupled can be adjusted separately. Thus, even if there is slack in the wire, or an error in mounting of the holding members, adjustment is possible in which both holding members synchronously change their postures and prevent a situation in which one of the left stand holding plate and the right stand holding plate is in the holding posture but the other is not.

According to the present invention, preferably, a pressing operation pin is provided on the bucket, the pressing operation pin being configured to abut, with a swing force of the bucket, against a bucket-side end location of the link operating member to press the link operating member.

According to the present configuration, with the simple operational structure in which only the pressing operation pin is provided on the bucket, it is possible to achieve an operational structure in which the link operating mechanism is activated with the swing force of the bucket.

Further, the present invention is directed to a working machine includes a vehicle body, and the front loader configured to be supported by the vehicle body.

According to the present configuration, it is easy to raise the stand even if the bending/stretching link has strong bending resistance, making it possible to immediately start a loader operation after coupling the front loader.

BRIEF DESCRIPTION OF THE DRAWINGS

FIG. 3 is a side view showing a stand at a raised/stored position;

FIG. 4 is a side view showing the stand at a lowered/used position, and a bending/stretching link in a propping and stretched state;

FIG. 5 is a view in section as taken along and seen in an arrow V-V in FIG. 4;

FIG. 13A is a diagram showing how to remove the front loader;

FIG. 13B is another diagram showing how to remove the front loader;

FIG. 13C is still another diagram showing how to remove the front loader;

FIG. 13D is yet still another diagram showing how to remove the front loader;

FIG. 13E is a further diagram showing how to remove the front loader; and

DESCRIPTION OF THE INVENTION

Figure 1:
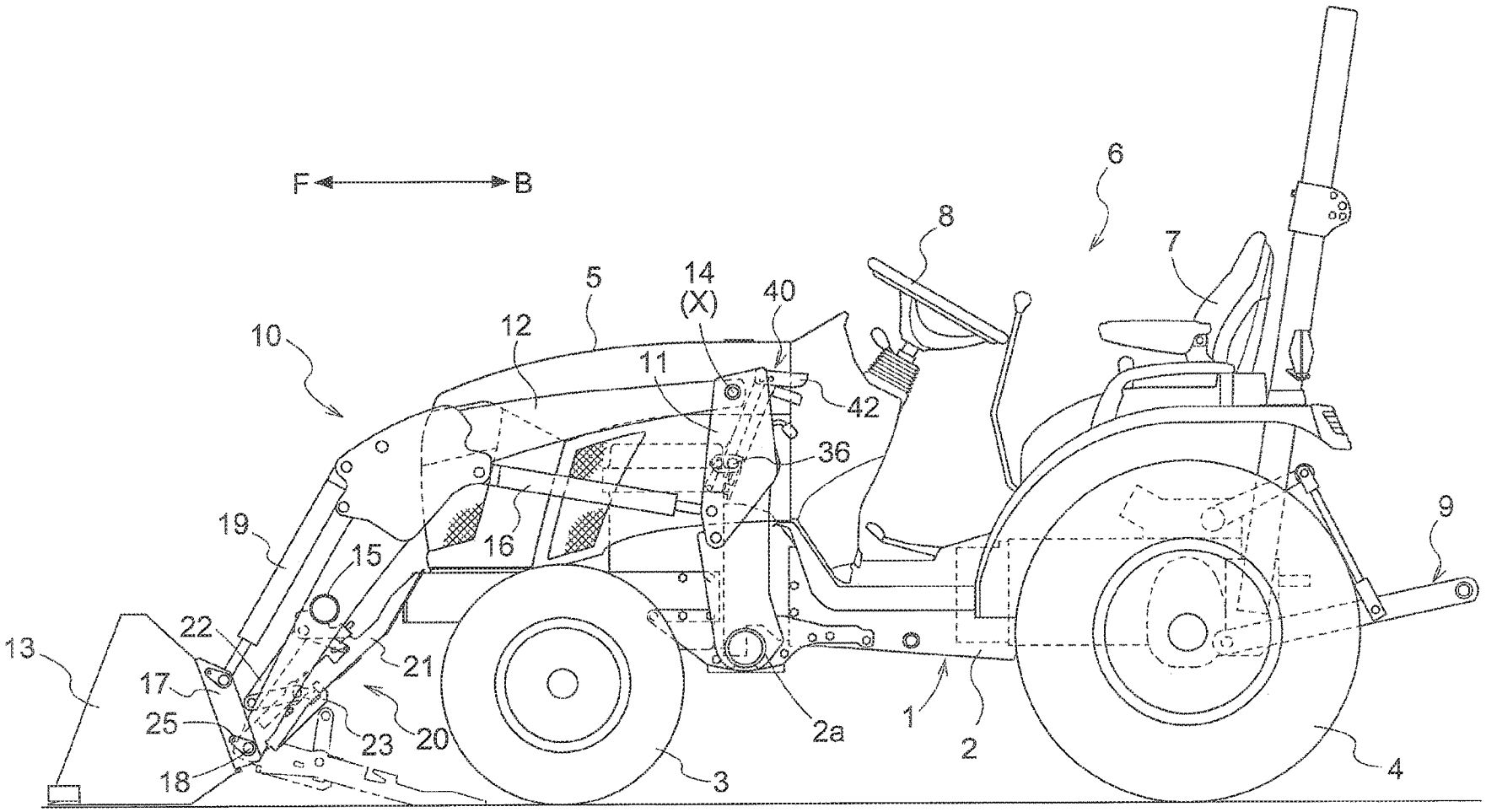
FIG. 1 is a left side view showing a tractor in its entirety to which a front loader is coupled.
Figure 2:
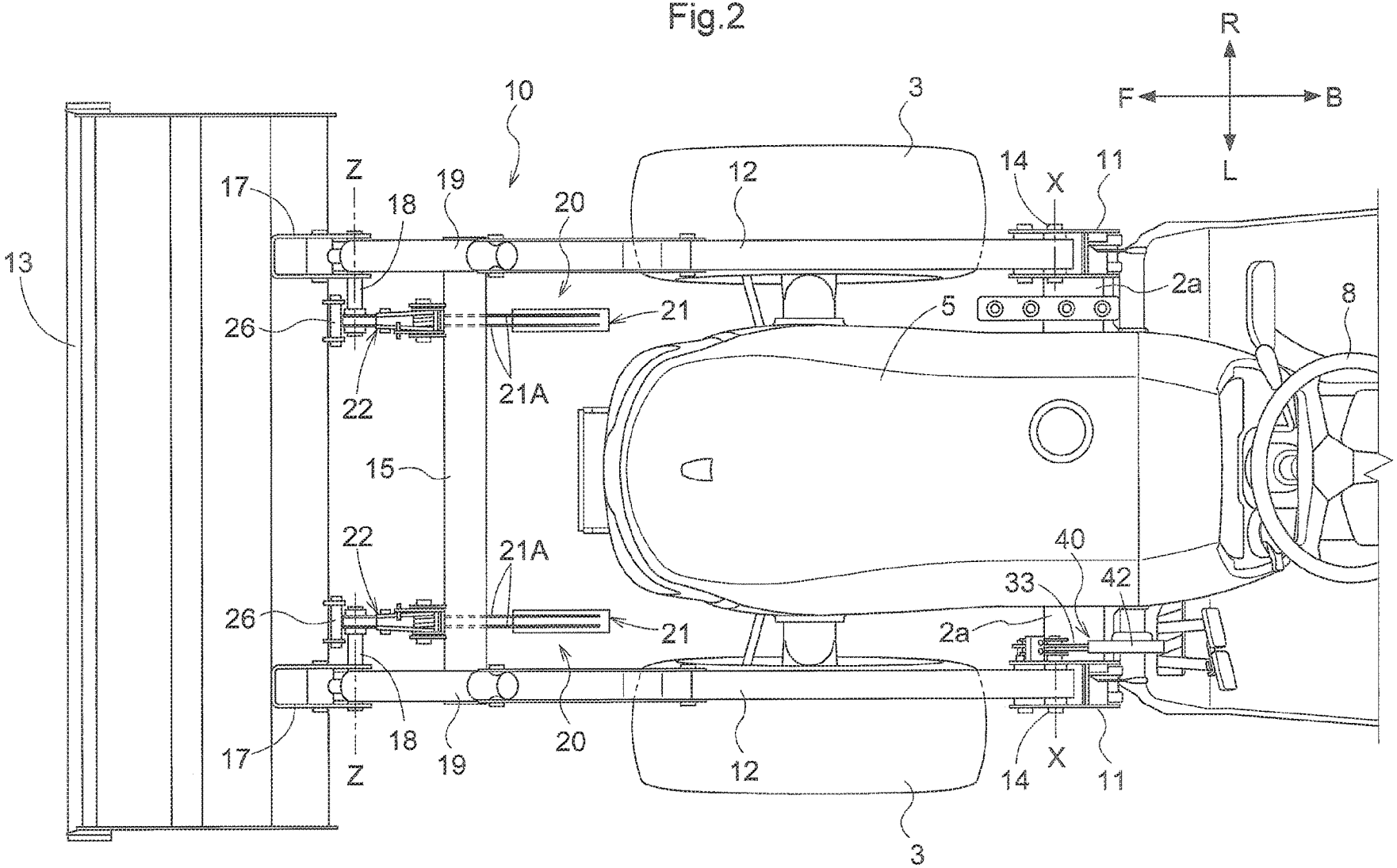
FIG. 2 is a plan view showing a front portion of the tractor and the front loader.

The following will describe embodiments of the present invention when it is applied to a tractor, which is an example of a working vehicle, with reference to the drawings. FIG. 1 is a left side view showing the tractor in its entirety. FIG. 2 is a plan view showing a front portion of the tractor. In FIGS. 1 and 2, the forward direction of a travel vehicle body 1 is defined as a direction [F], and the backward direction of the travel vehicle body 1 is defined as a direction [B], and in FIG. 2, the leftward direction of the travel vehicle body 1 is defined as a direction [L], and the rightward direction of the travel vehicle body 1 is defined as a direction [R].

Overall Structure of Tractor

As shown in FIGS. 1 and 2, the tractor includes the travel vehicle body 1 including a vehicle body frame 2 that supports, in its front portion, a pair of left and right front wheels 3 so that they are drivable and steerable, and supports, in its rear portion, a pair of left and right rear wheels 4 so that they are drivable. A prime mover portion 5 with an engine is formed in a front portion of the travel vehicle body 1. A driving portion 6 is formed in a rear portion of the travel vehicle body 1. The driving portion 6 includes a driver seat 7 and a steering wheel 8 for steering the front wheels 3. A link mechanism 9 extends from the rear portion of the travel vehicle body 1 in the backward direction of the vehicle body. Various types of working devices such as a rotary cultivating device (not shown) can be coupled to the rear portion of the travel vehicle body 1 via the link mechanism 9 so as to be raised and lowered, allowing various types of working machines such as a passenger cultivator to be realized. A front loader 10 is removably coupled to the front portion of the travel vehicle body 1.

Front Loader 10

As shown in FIGS. 1 and 2, the front loader 10 includes: coupling frames 11 supported on both lateral side portions of the travel vehicle body 1; a left boom 12 that is provided in the left lateral side portion of the front loader 10 and extends from the upper portion of the left coupling frame 11 in the forward direction of the vehicle body; a right boom 12 that is provided in the right lateral side portion of the front loader 10 and extends from the upper portion of the right coupling frame 11 in the forward direction of the vehicle body; and a single bucket 13 that is supported spanning the front ends of the left and right booms 12.

The left and right coupling frames 11 are removably coupled to support portions 2*a* provided in the lateral side portions of the vehicle body frame 2. Support shafts 14 are provided in the base portions of the left and right booms 12, and the left and right booms 12 are supported by the coupling frames 11 via the support shafts 14 so as to be swingable up and down with the axes X of the support shafts 14 that extend in a lateral direction of the vehicle body used as the pivot points. Midway portions of the left and right booms 12 are coupled to each other via a boom coupling frame 15. A left boom cylinder 16 is coupled spanning the left coupling frame 11 and the left boom 12. A right boom cylinder 16 is coupled spanning the right coupling frame 11 and the right boom 12. The left and right booms 12 are raised and lowered through extension and retraction operations of the boom cylinders 16.

Coupling brackets 17 are provided in a left end portion and a right end portion on the back of the bucket 13. The bucket 13 is supported by the left and right booms 12 via coupling shafts 18 mounted on the coupling brackets 17, so as to be swingable up and down with axes Z of the coupling shafts 18 that extend in the lateral direction of the vehicle body used as the pivot points. A left bucket cylinder 19 is coupled spanning the left boom 12 and the left coupling bracket 17. A right bucket cylinder 19 is coupled spanning the right boom 12 and the right coupling bracket 17. The bucket 13 is operated to swing between a scooping posture and a discharging posture with extension and retraction operations of the left and right bucket cylinders 19.

The front loader 10 is coupled to the travel vehicle body 1 as a result of the left and right coupling frames 11 of the front loader 10 being coupled to the support portions 2*a*. In the state in which the front loader 10 is coupled to the travel vehicle body 1, the left boom 12 is coupled to the left lateral side portion of the travel vehicle body 1 so as to be swingable up and down, and the right boom 12 is coupled to the right lateral side portion of the travel vehicle body 1 so as to be swingable up and down. As a result of the left and right booms 12 being raised and lowered, the bucket 13 is raised and lowered with respect to the travel vehicle body 1. The front loader 10 is removed from the travel vehicle body 1 as a result of the left and right coupling frames 11 being removed from the support portions 2*a*. Note however that attaching and detaching a hydraulic pressure hose on the front loader 10 side to and from a hydraulic piping on the travel vehicle body 1 side is performed independently from attaching and detaching the coupling frames 11 to and from the support portions 2*a*.

Stand

As shown in FIGS. 1-3, the front loader 10 includes: a left stand unit 20 provided corresponding to the left boom 12; and a right stand unit 20 provided corresponding to the right boom 12. The left and right stand units 20 are each provided with a stand 21, a bending/stretching link 22, a link operating mechanism 23, and a holding member 24. The structures of the left and right stand units 20 differ from each other in that the stand 21, the bending/stretching link 22, and the holding member 24 of the left stand unit 20 are coupled to the left boom 12, and the stand 21, the bending/stretching link 22, and the holding member 24 of the right stand unit 20 are coupled to the right boom 12. Otherwise, the remaining structure of the left and right stand units 20 is the same, and thus the following description will be given without distinguishing between left and right as needed, except for cases where it is necessary to distinguish between left and right.

As shown in FIGS. 2 and 3, the stand 21 includes a pair of left and right longitudinal plate portions 21A arranged side by side at a distance in the lateral direction of the vehicle body, and a first coupling portion 21B and a second coupling portion 21C that are located in lower portions of the pair of left and right longitudinal plate portions 21A. The first coupling portion 21B couples the left and right longitudinal plate portions 21A at an intermediate portion, in the front/rear direction of the vehicle body, of the stand 21. The second coupling portion 21C couples the left and right longitudinal plate portions 21A at a free end portion of the stand 21. The second coupling portion 21C constitutes a ground contact portion of the stand 21. Hereinafter, the second coupling portion 21C is referred to as "ground contact portion 21C".

As shown in FIGS. 2 and 3, the stand 21 is provided on one of two lateral sides of the boom 12 that is closer to the center, in the left-right direction of the vehicle body, of the bucket 13. In other words, the stand 21 is provided inward, in the lateral direction of the vehicle body, of the boom 12. The stand 21 is supported at the front end of the boom 12 via the coupling shaft 18 mounted on the front end of the stand 21, so as to be able to be raised and lowered between a lowered/used position (see FIG. 4) at which it is lowered with respect to the boom 12 with the axis Z of the coupling shaft 18 that extends in the lateral direction of the vehicle body used as the pivot point, and a raised/stored position (see FIG. 3) at which it is raised with respect to the boom 12. The stands 21 are coupled to the booms 12 and the bucket 13 is coupled to the booms 12 using the common coupling shafts 18. Rotation prevention members 25 (see FIG. 1) are each coupled spanning the coupling shaft 18 and the coupling bracket 17 of the bucket 13. The rotation prevention members 25 prevent the coupling shafts 18 from rotating with respect to the coupling brackets 17.

Figure 7:
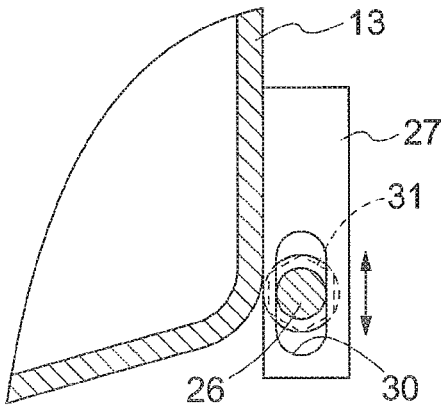
FIG. 7 is a view in vertical section view showing a stand operating portion.

As shown in FIGS. 3 and 4, stand operating portions 26 are provided on the back of the bucket 13. As shown in FIG. 7, the stand operating portions 26 are each constituted by a round bar member coupled to the bucket 13 via a pair of left and right support members 27. The left and right support members 27 are coupled to the bucket 13 through welding. As shown in FIGS. 3 and 4, an operation target surface 21*d* is formed at the front end portion of the stand 21. If the bucket 13 is operated to swing downward, then the stand operating portions 26 hit against the operation target surfaces 21*d* so that the operation target surfaces 21*d* are pressed against by the stand operating portions 26, and the stands 21 are raised by the swing force of the bucket 13 and switch to the raised/stored position. If the bucket 13 is operated to swing upward, then the pressing operation of the stand operating portions 26 performed on the operation target surfaces 21*d* is released, and the stands 21 are lowered by gravity and switch to the lowered/used position.

As shown in FIGS. 2, 3 and 4, the bending/stretching link 22 is provided on a lateral side of the boom 12, spanning the boom 12 and the free end side of the stand 21.

Figure 6:
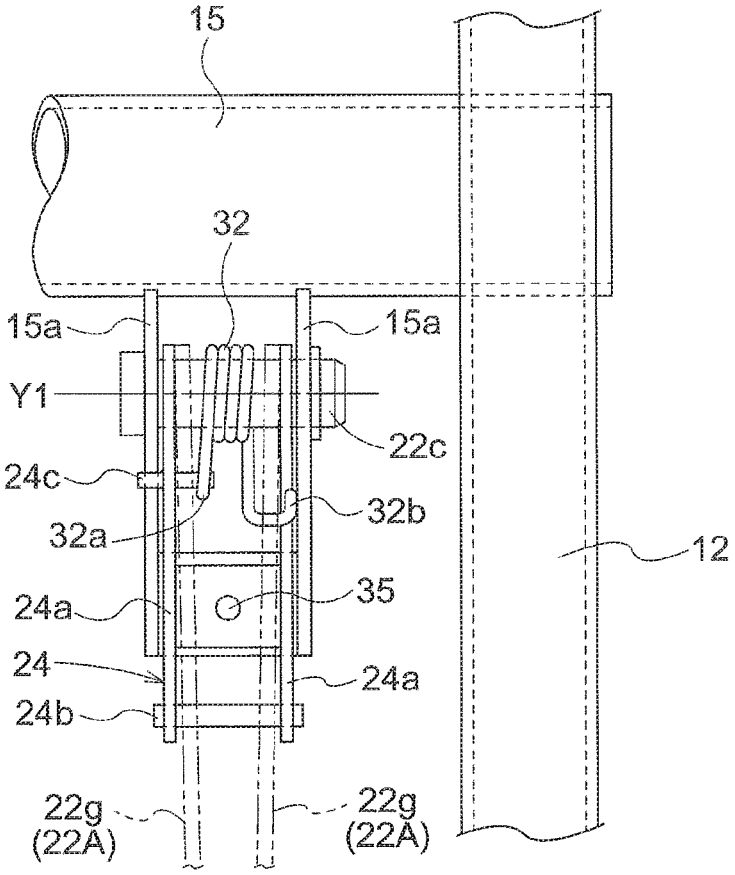
FIG. 6 is a plan view showing a support structure of a holding member.

Specifically, as shown in FIGS. 3 and 4, the bending/stretching link 22 includes a operation target surface 22A and a stand-side arm 22B. As shown in FIGS. 3, 4 and 6, the boom-side end portion of the boom-side arm 22A is supported by a pair of left and right support portions 15*a* via a support shaft 22*c*. The left and right support portions 15*a* are provided on the boom coupling frame 15 that couples the left and right booms 12. The left and right support portions 15*a* are coupled to the boom coupling frame 15 through welding. The boom-side arm 22A is supported on the boom 12 via the support shaft 22*c*, the support portions 15*a*, and the boom coupling frame 15, and the boom-side arm 22A is supported on the boom 12 so as to be swingable with a axis Y1 of the support shaft 22*c* that extends in the lateral direction of the travel vehicle body 1 used as the pivot point. As shown in FIGS. 3 and 4, the stand-side end portion of the stand-side arm 22B is coupled to the stand 21 via a coupling shaft 22*d*. The stand-side arm 22B is coupled to the stand 21 so as to be relatively swingable with a axis Y2 of the coupling shaft 22*d* that is parallel to the axis Y1 used as the pivot point. The free end portion of the boom-side arm 22A and the free end portion of the stand-side arm 22B are coupled to each other by a coupling shaft 22*e* so as to be relatively swingable. The boom-side arm 22A includes a pair of left and right link members 22*g*. The left and right link members 22*g* and the stand-side arm 22B are coupled to each other by the coupling shaft 22*e* so as to be relatively swingable in a state in which the free end portion of the stand-side arm 22B is sandwiched between the free end portions of the left and right link members 22*g* from both lateral sides.

As shown in FIG. 3, when the stand 21 is at the raised/stored position, the bending/stretching link 22 is in a bent state in which the axis of the coupling shaft 22*e* is located forward of a straight line T1 that connects the axis Y1 of the support shaft 22*c* and the axis Y2 of the coupling shaft 22*d*, when seen from the vehicle body side. As shown in FIG. 6, a coil-shaped spring 32 is supported on the support shaft 22*c*. One-end portion 32*a* of the spring 32 is latched onto a later-described holding member 24, and another-end portion 32*b* of the spring 32 is latched onto one link member 22*g*. As the stand 21 swings downward, the bending/stretching link 22 is operated to stretch from the bent state in which the stand 21 is at the raised/stored position, due to the descending force of the stand 21 and the action force of the spring 32. The bending/stretching link 22 is operated to stretch until the stand-side arm 22B hits against a stopper portion 21*s* provided on the stand 21. As shown in FIG. 4, when the stand-side arm 22B is in contact with the stopper portion 21*s*, the bending/stretching link 22 is in a stretched state in which the axis of the coupling shaft 22*e* is located rearward of a straight line T2 that connects the axis Y1 of the support shaft 22*c* and the axis Y2 of the coupling shaft 22*d*, when seen from the vehicle body side. The posture change of the bending/stretching link 22 from a stretched state in which the axis Y1 of the support shaft 22*c*, the axis of the coupling shaft 22*e*, and the axis Y2 of the coupling shaft 22*d* are in a straight line, to the stretched state in which the axis of the coupling shaft 22*e* is located rearward of the straight line T2 that connects the axis Y1 of the support shaft 22*c* and the axis Y2 of the coupling shaft 22*d* is made by the action force of the spring 32. Upon reaching the stretched state in which the stand-side arm 22B is in contact with the stopper portion 21*s*, the bending/stretching link 22 is stretched while being supported on the stopper portion 21*s* so as to not bend even if a ground reaction force is applied to the stand 21. That is, upon reaching the stretched state in which the bending/stretching link 22 is supported by the stopper portion 21*s*, the bending/stretching link 22 is in a propping and stretched state in which it props and supports the stand 21 at the lowered/used position against the ground reaction force.

As the stand 21 is operated upward, the bending/stretching link 22 is operated to bend due to the ascending force of the stand 21, allowing the stand 21 to change its posture to the raised/stored position.

As shown in FIGS. 3 and 4, the link operating mechanism 23 includes a link operating member 28 and with the stand operating portion 26 as a pressing operation pin. As shown in FIG. 5, the link operating member 28 is provided between the left and right longitudinal plate portions 21A of the stand 21, and is covered by the left and right longitudinal plate portions 21A from both lateral sides. The link operating member 28 is protected by the longitudinal plate portions 21A so as to be unlikely to collide with a stone or the like.

As shown in FIGS. 3 and 4, the link operating member 28 has, in the front portion thereof, a cut-out recess 28*a*. The link operating member 28 has, in the rear portion thereof, guide pins 28*b*. As shown in FIG. 5, the guide pins 28*b* protrude outward from both lateral sides of the link operating member 28. In the front portion of the link operating member 28, the cut-out recess 28*a* is slidably fitted to the coupling shaft 18. The guide pins 28*b* on both lateral sides in the rear portion are slidably fitted into mounting holes 29 in the shape of elongated holes that are formed in the left and right longitudinal plate portions 21A of the stand 21 and extend in the longitudinal direction of the stand 21. The front-end side of the link operating member 28 is slidably supported on the stand 21 via the cut-out recess 28*a* and the coupling shaft 18, and the rear end side of the link operating member 28 is slidably supported on the stand 21 via the left and right guide pins 28*b*. The link operating member 28 is supported so as to be slidable in the longitudinal direction of the stand 21.

The link operating member 28 includes, in a bucket side end portion thereof, an operation target surface 28*c*. The link operating member 28 has, in a rear portion thereof, a link operating surface 28*d*. As shown in FIG. 4, when the stand 21 is at the lowered/used position, a lower portion 22*f*, located below the coupling shaft 22*d*, of the stand-side arm 22B of the bending/stretching link 22 in the propping and supporting state hits against the link operating surface 28*d* of the link operating member 28, and the link operating member 28 is pressed by the stand-side arm 22B to the front, and is supported by the stand 21 in a state in which the operation target surface 28*c* is located forward of the operation target surface 21*d* of the stand 21.

In the link operating mechanism 23, when the stand 21 is at the lowered/used position, upon the bucket 13 swinging downward, the stand operating portion 26 serving as the pressing operation pin hits against, before hitting against the operation target surface 21*d* of the stand 21, the operation target surface 28*c* of the link operating member 28 and presses against the link operating member 28, and the link operating member 28 is operated with the swing force of the bucket 13 to slide rearward in the longitudinal direction of the stand 21. When the link operating member 28 is operated to slide, the link operating surface 28*d* of the link operating member 28 hits against the lower portion 22*f* of the stand-side arm 22B and presses against the lower portion 22*f* of the stand-side arm 22B, and the bending/stretching link 22 is operated by the link operating member 28 so that the propping and supporting state is released. That is, prior to the stand operating portion 26 hitting against the operation target surface 21*d* of the stand 21 to start raising the stand 21, the stand operating portion 26 hits against the operation target surface 28*c* of the link operating member 28 so that the link operating member 28 is pressed rearward by the stand operating portion 26 and the bending/stretching link 22 is forcibly operated by the link operating member 28 so as to bend, thus releasing the propping and supporting state.

As shown in FIG. 7, mounting holes 30 for round bar member that are formed in the left and right support members 27 are elongated hole shaped. The round bar member moves in the mounting holes 30 in an adjusted manner in a direction that corresponds to the swing direction of the bucket 13, and is configured to be fastened and fixed at the adjusted position with screw members 31. By adjusting the position at which the round bar member is to be fixed, it is possible to adjust the timings at which, with the swinging of the bucket 13, the stand operating portion 26 hits against the operation target surface 28*c* of the link operating member 28 and the operation target surface 21*d* of the stand 21. It is possible to adjust the timing for the left stand unit 20 and the timing for the right stand unit 20 separately.

As shown in FIGS. 3, 4 and 6, the holding member 24 is mounted on a lateral side of the boom 12. The holding member 24 is supported on the pair of left and right support portions 15*a* via the support shaft 22*c*. The holding member 24 is supported on the boom 12 via the support shaft 22*c*, the support portions 15*a*, and the boom coupling frame 15, and is supported so as to be swingable between a holding posture and a releasing posture with the axis Y1 of the support shaft 22*c* used as the pivot point. The holding member 24 includes a pair of left and right holding plates 24*a* supported by the support shaft 22*c*, and a coupling pin 24*b* that couples the free end sides of the left and right holding plates 24*a*.

As shown in FIG. 3, when the holding member 24 is switched to the holding posture in the state in which the posture of the stand 21 has changed to the raised/stored position, the holding member 24 engages, using the coupling pin 24*b*, with a hook portion 21*e* provided in the stand 21, and the stand 21 is held at the raised/stored position by the holding member 24. When the posture of the holding member 24 is switched to the releasing posture, the coupling pin 24*b* disengages from the hook portion 21*e* to allow the stand 21 to lower from the raised/stored position.

As shown in FIGS. 3, 4 and 6, one of the holding plates 24*a* includes a spring latch pin 24*c* in the portion opposite to the side on which the coupling pin 24*b* is located, with respect to the support shaft 22*c*. One-end portion 32*a* of the spring 32 is latched onto the spring latch pin 24*c*. The holding member 24 is biased by the spring 32, serving as an elastic member, to swing into the releasing posture. In place of the spring 32, various types of elastic members such as a piece of rubber may also be employed.

Figure 8:
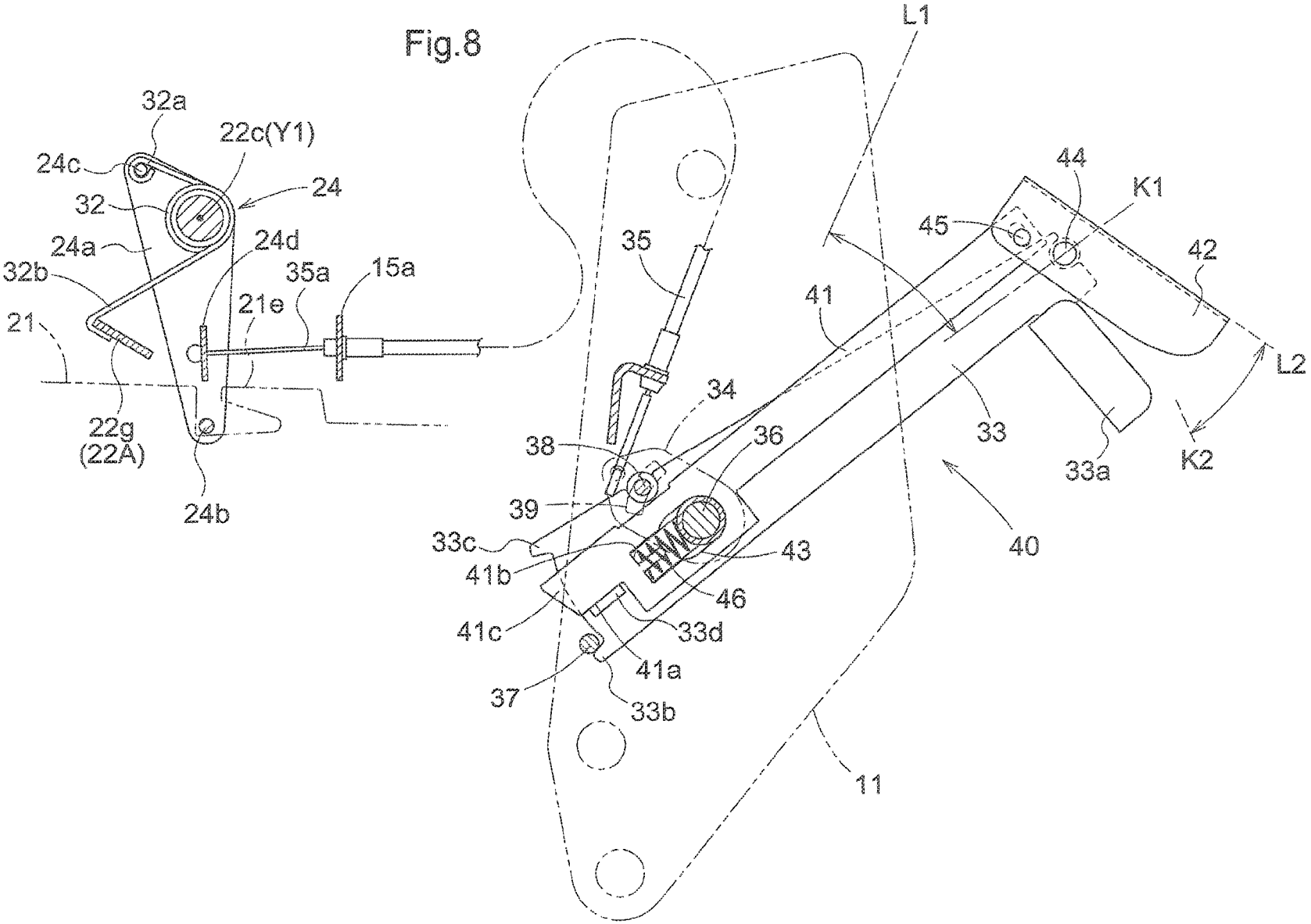
FIG. 8 is a side view showing a coupling structure between the holding member and an operation tool, and the operation tool at an unlocked position.

As shown in FIG. 8, the holding member 24 includes a wire coupling plate 24*d*. The wire coupling plate 24*d* is formed in a portion of the holding member 24 that is located between the support shaft 22*c* and the coupling pin 24*b*, spanning the pair of holding plates 24*a*. As a result of an inner wire 35*a* of a wire 35 being coupled between the wire coupling plate 24*d* and a wire coupling plate 34 of an operation tool 33, the holding member 24 and the operation tool 33 are coupled to each other via the wire 35.

Figure 9:
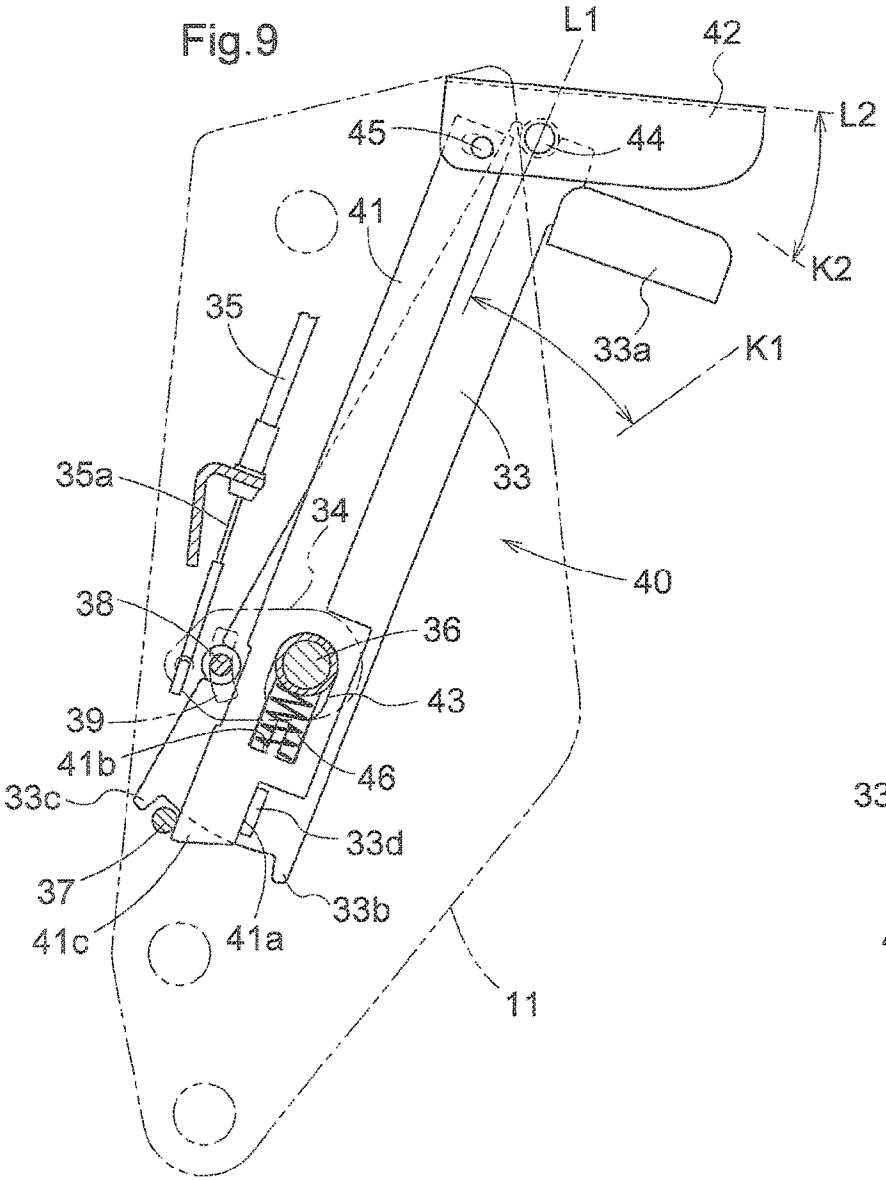
FIG. 9 is a side view showing the operation tool at a locked position, and an operation tool lock in a locking state.

As shown in FIGS. 2 and 8, the operation tool 33 is supported inward of the vehicle body in a lateral side portion of the left coupling frame 11 via a support shaft 36, and is supported so as to be swingable between a locked position L1 and an unlocked position K1 with the support shaft 36 used as the pivot point. As shown in FIG. 8, the operation tool 33 includes, in the upper portion thereof, a grip arm 33*a* serving as an operation portion for an operator to operate the operation tool 33. As shown in FIG. 8, the operation tool 33 is at the unlocked position K1, as a result of the grip arm 33*a* being operated to the lower side until a first positioning surface 33*b* formed in the base portion of the operation tool 33 hits against a stopper 37. As shown in FIG. 9, the operation tool 33 is at the locked position L1, as a result of the grip arm 33*a* being operated to the upper side until a second positioning surface 33*c* formed in the base portion of the operation tool 33 hits against the stopper 37. The stopper 37 is formed on the coupling frame 11.

Figure 11:
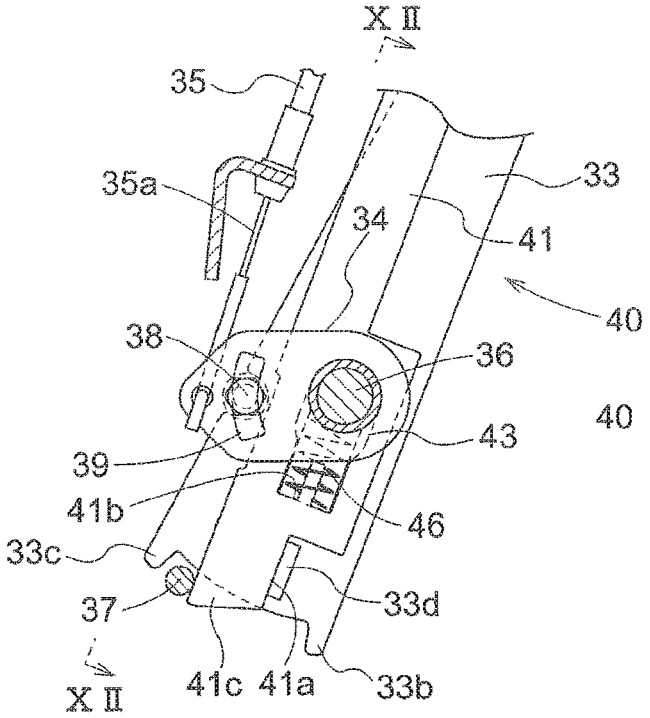
FIG. 11 is a side view showing a structure in which a wire is coupled to the operation tool.
Figure 12:
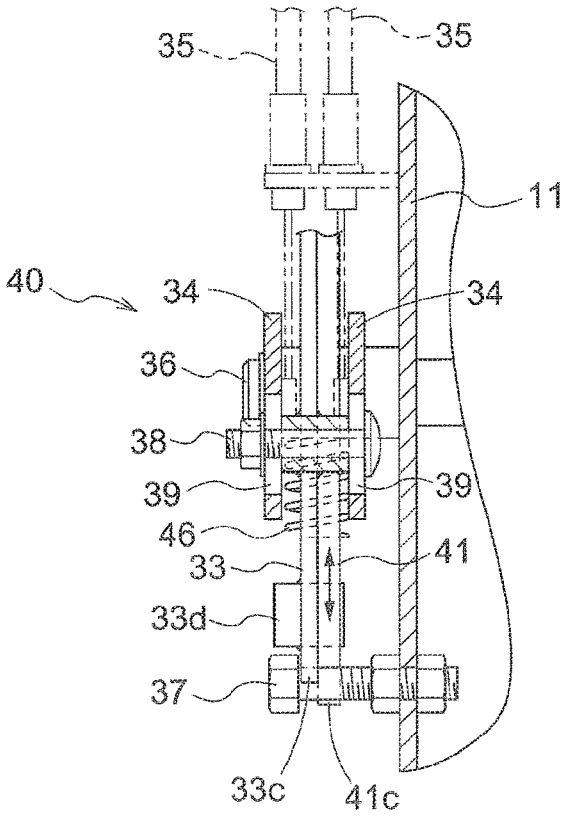
FIG. 12 is a view in section as taken along and seen in an arrow XII-XII in FIG. 11.

As shown in FIGS. 8, 11 and 12, the wire coupling plate 34 of the operation tool 33 is supported on the operation tool 33 via the support shaft 36 and a positioning screw member 38. A screw member hole 39 through which the positioning screw member 38 of the wire coupling plate 34 is inserted has the shape of an arc-like elongated hole with the axis of the support shaft 36 located in the center. By releasing the wire coupling plate 34 fastened to the operation tool 33 by the positioning screw member 38, the wire coupling plate 34 can swing relative to the operation tool 33 using the support shaft 36 as the pivot point, within the range of the screw member hole 39, and thus it is possible to change and adjust the position of the operation tool 33 to which the wire coupling plate 34 is coupled. By screwing the positioning screw member 38 to fasten the wire coupling plate 34 to the operation tool 33, it is possible to fix the wire coupling plate 34 to the operation tool 33 at the changed and adjusted coupling position.

As shown in FIG. 9, as a result of the operation tool 33 being brought into the locked position L1, the inner wire 35*a* is drawn and the holding member 24 is switched to the holding posture against the force of the spring 32. As shown in FIG. 8, as a result of the operation tool 33 being brought into the unlocked position K1, the inner wire 35*a* loosens and the holding member 24 is switched to the releasing posture by the spring 32.

As shown in FIG. 8, an operation tool lock 40 is provided spanning the operation tool 33 and the coupling frame 11. The operation tool lock 40 includes a lock member 41 and an unlock operation tool 42, and is also provided with the stopper 37 that acts on the operation tool 33, as a stopper that acts on the lock member 41.

As shown in FIG. 8, the lock member 41 is provided between the operation tool 33 and the coupling frame 11. The base portion of the lock member 41 includes a mounting hole 43 in the shape of an elongated hole through which the support shaft 36 is inserted, and a guide target portion 41*a* that is slidably supported on a supporting guide plate 33*d* formed on the operation tool 33. The base portion of the lock member 41 is slidably supported on the operation tool 33 via the mounting hole 43, the support shaft 36, and the guide target portion 41*a*. The unlock operation tool 42 is supported on the grip arm 33*a* of the operation tool 33 via a support shaft 44. One-end portion of the unlock operation tool 42 and the top end of the lock member 41 are operably coupled to each other via a coupling pin 45. The top end side of the lock member 41 is supported on the operation tool 33 via the coupling pin 45, the unlock operation tool 42, and the support shaft 44.

Figure 10:
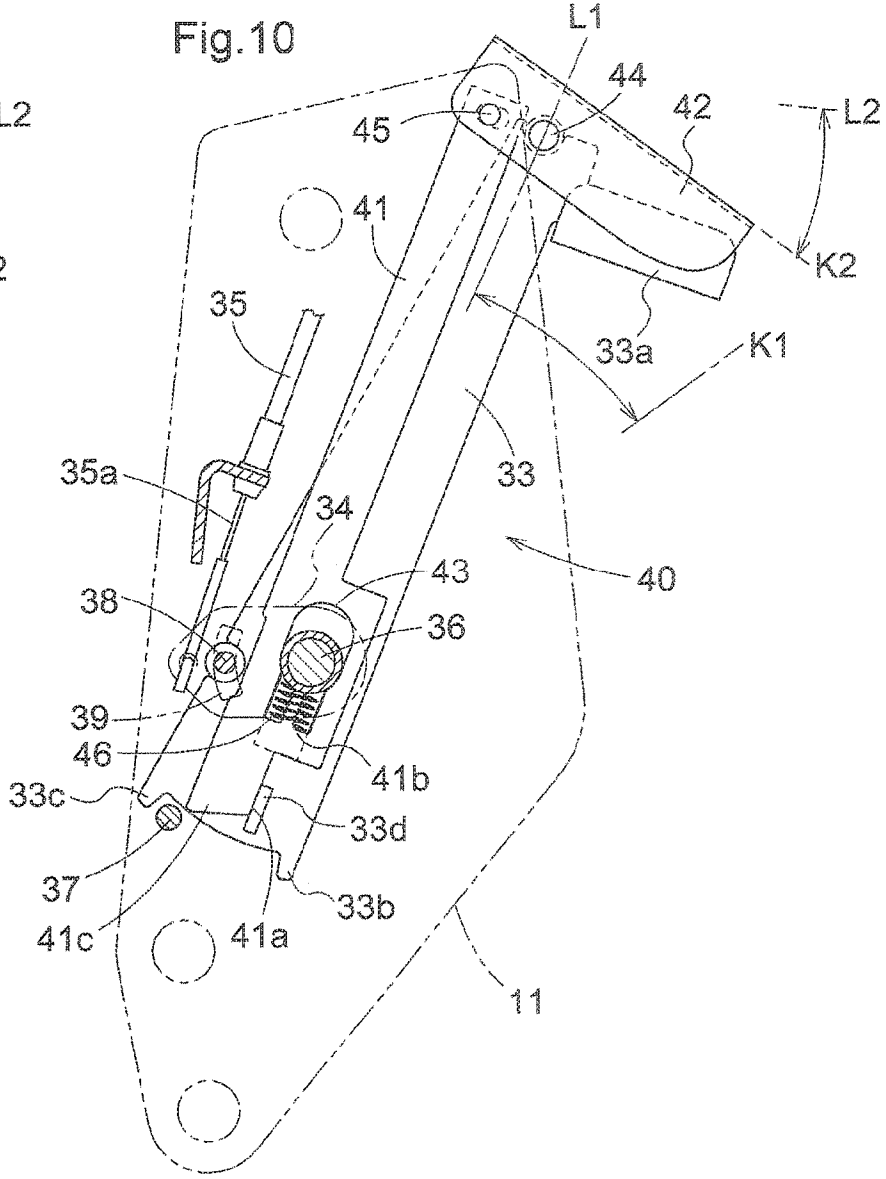
FIG. 10 is a side view showing the operation tool at the locked position, and the operation tool lock in an unlocking state.

As shown in FIGS. 8 and 10, the unlock operation tool 42 is supported on the grip arm 33*a* so as to be swingable with the support shaft 44 used as the pivot point, between an operation tool unlocking position K2 and an operation tool locking position L2. The unlock operation tool 42 is supported so that it is possible to grip the unlock operation tool 42 together with the grip arm 33*a* of the operation tool 33. The unlock operation tool 42 is supported so as to come into the operation tool unlocking position K2 when it is gripped together with the grip arm 33*a*. The unlock operation tool 42 and the grip arm 33*a* are coupled to each other so that the free end side of the unlock operation tool 42 overlaps the grip arm 33*a* from above when the unlock operation tool 42 is at the operation tool unlocking position K2. It is easy to grip the unlock operation tool 42 and the grip arm 33*a* together.

As shown in FIGS. 8, 9 and 10, the lock member 41 includes a spring receiving portion 41*b* below the mounting hole 43 in the lock member 41. A spring 46 is arranged between the spring receiving portion 41*b* and the support shaft 36. The spring 46 extends from the spring receiving portion 41*b* and is supported on a spring support portion that enters the coil of the spring 46. The lock member 41 is biased by the spring 46 to be lowered with respect to the operation tool 33, and the unlock operation tool 42 is biased to the operation tool locking position L2 when the lock member 41 is biased to be lowered by the spring 46.

As shown in FIG. 9, when the unlock operation tool 42 is brought into the operation tool locking position L2, the lock member 41 is lowered with respect to the operation tool 33 by the spring 46, and a lock portion 41*c* formed in the base portion of the lock member 41 is caused to protrude from the operation tool 33 toward the stopper 37. When the lock portion 41*c* is caused to protrude, the lock portion 41*c* can engage with the stopper 37 on the side of the stopper 37 that is opposite to the side on which the second positioning surface 33*c* of the operation tool 33 is located. As shown in FIG. 10, when the unlock operation tool 42 is brought into the operation tool unlocking position K2, the lock member 41 is raised with respect to the operation tool 33 against the force of the spring 46 due to the swing force of the unlock operation tool 42. When the lock member 41 is raised, the lock portion 41*c* is retracted upward relative to the stopper 37, and can disengage from the stopper 37.

In the operation tool lock 40, when, as shown in FIG. 9, the operation tool 33 is at the locked position L1 and the lock member 41 is lowered with respect to the operation tool 33 due to the action force of the spring 46, the lock portion 41*c* engages with the stopper 37, resulting in the operation tool lock 40 being in the locking state. Accordingly, the operation tool 33 is held at the locked position L1 by the operation tool lock 40 against the force of the spring 32 that acts on the operation tool 33 via the wire 35 and the holding member 24. When the operation tool lock 40 is in the locking state, the free end side of the unlock operation tool 42 swings upward with respect to the grip arm 33*a* due to the action force of the spring 46 with the support shaft 44 used as the pivot point, and the unlock operation tool 42 moves to the operation tool locking position L2.

In the operation tool lock 40, when, as shown in FIG. 10, the unlock operation tool 42 is gripped together with the grip arm 33*a* of the operation tool 33 and is brought into the operation tool unlocking position K2, the lock member 41 is raised with respect to the operation tool 33 against the force of the spring 46 and the lock portion 41*c* is disengaged from the stopper 37, resulting in the operation tool lock 40 being in the unlocking state. Accordingly, holding of the operation tool 33 the locked position L1 by the operation tool lock 40 is released.

When the operation tool 33 is brought into the unlocked position K1, the lock portion 41*c* of the lock member 41 runs on the stopper 37, and is stopped and supported by the stopper 37 so that the lock member 41 is not lowered with respect to the operation tool 33, and thus the unlock operation tool 42 is held at the operation tool unlocking position K2. When the operation tool 33 is switched from the unlocked position K1 to the locked position L1, the lock portion 41*c* slides relative to the stopper 37 while running on the stopper 37 until the operation tool 33 reaches the locked position L1, and the lock member 41 is retained and supported by the stopper 37 so as to not be lowered with respect to the operation tool 33. When the operation tool 33 is at the locked position L1, the lock portion 41*c* no longer runs on the stopper 37 but engages with the stopper 37.

When the holding member 24 is switched from the releasing posture to the holding posture, the operation tool lock 40 is held in the unlocking state until the operation tool 33 is switched to the locked position L1, and thus it is possible to switch the operation tool 33 to the locked position L1 from the unlocked position K1 without bringing the unlock operation tool 42 into the operation tool unlocking position K2, and to switch the holding member 24 to the holding posture. When the operation tool 33 is at the locked position L1, the operation tool lock 40 is switched to the locking state by the spring 46, the operation tool 33 is held at the locked position L1 by the operation tool lock 40, and the holding member 24 is held in the holding posture against the force of the spring 32.

As shown in FIGS. 11 and 12, the operation tool 33 includes: a wire coupling plate 34 that is operably coupled to the holding member 24 of the left stand unit 20 via the wire 35; and a wire coupling plate 34 that is operably coupled to the holding member 24 of the right stand unit 20 via the wire 35. The left wire coupling plate 34 and the right wire coupling plate 34 have the same configuration. As shown in FIG. 12, the left wire coupling plate 34 is fixed to the operation tool 33 and the right wire coupling plate 34 is fixed to the operation tool 33 using the common positioning screw member 38.

The holding members 24 of the left and right stand units 20 are operably coupled to the operation tool 33 common to the left and right stand units 20, and thus it is possible to switch the holding members 24 of the left and right stand units 20 together between the holding posture and the releasing posture simply by operating the operation tool 33. Furthermore, it is possible to change and adjust the coupling position of the operation tool 33 to which the wire 35 of the left holding member 24 is coupled, by adjusting the coupling position between the operation tool 33 and the wire coupling plate 34 to which the wire 35 of the holding member 24 of the left stand unit 20 is coupled. It is possible to change and adjust the coupling position of the operation tool 33 to which the wire 35 of the right holding member 24 is coupled, by adjusting the coupling position between the operation tool 33 and the wire coupling plate 34 to which the wire 35 of the holding member 24 of the right stand unit 20 is coupled. Even if there is slack in the wire 35 or an error in mounting of the left and right holding members 24, it is possible to separately change and adjust the coupling position of the operation tool 33 to which the wire 35 of the left holding member 24 is coupled, and the coupling position of the operation tool 33 to which the wire 35 of the right holding member 24, and it is possible to perform wire adjustment so that the left and right holding members 24 synchronously change their postures between the holding posture and the releasing posture.

The front loader 10 is removed from the travel vehicle body 1 in accordance with the procedure shown from FIGS. 13A to 13E. As shown in FIG. 13A, the booms 12 are raised to lift the stands 21 at the raised/stored position. The bucket 13 is swung downward, and the stands 21 are brought into the state in which, even if holding of the stands 21 at the raised/stored position by the holding members 24 is released, they do not lower at once, as a result of the stand operating portions 26 receiving the operation target surfaces 21*d* of the stands 21, namely, as shown in FIG. 3, the stand operating portions 26 hitting against the operation target surfaces 21*d* of the stands 21 or being located in the vicinity of the front portions of the operation target surfaces 21*d*, and then the operation tool 33 is brought into the unlocked position K1 to switch the holding members 24 to the releasing posture. When the operation tool 33 is brought into the unlocked position K1, the unlock operation tool 42 is gripped together with the grip arm 33*a* of the operation tool 33, whereby the operation tool lock 40 is switched to the unlocking state, making it possible to bring the operation tool 33 into the unlocked position K1.

Upon completion of the switching of the holding members 24 to the releasing posture, as shown in FIG. 13B, the bucket 13 is raised to move the stand operating portions 26 upward, and the stands 21 are lowered.

As shown in FIG. 13C, when the stands 21 are at the lowered/used position, the booms 12 are lowered and the bucket 13 is brought into contact with the ground. When the bucket 13 is engaged on the ground, the booms 12 are further lowered, and the front wheels 3 are raised from the ground. When the front wheels 3 are raised from the ground, coupling locking mechanisms 47 that keep the left and right coupling frames 11 coupled to the support portions 2*a* are switched to an unlocking state.

As shown in FIG. 13D, the left and right coupling frames 11 are unlocked and uncoupled from the support portions 2*a*, the front wheels 3 are engaged on the ground G, and then the bucket 13 is raised slightly so that the stands 21 are adjusted into a posture-to-ground in which the ground contact portions 21C are engaged on the ground. Specifically, when the stands 21 are brought into contact with the ground, the booms 12 are raised so that the coupling frame sides of the booms 12 are raised with the sides of the booms 12 that are coupled to the bucket 13 used as the pivot points, and the coupling frames 11 are raised with respect to the support portions 2*a*, thus uncoupling the coupling frames 11 from the support portions 2*a*.

As shown in FIG. 13E, when the coupling frames 11 are uncoupled from the support portions 2*a*, the travel vehicle body 1 is moved backward so that the coupling frames 11 are located in front of the support portions 2*a*. Because the bending/stretching links 22 are in the propping and stretched state, and the stands 21 are kept at the lowered/used position against the ground reaction force, the booms 12 are supported off the ground in a posture-to-ground when the coupling frames 11 are uncoupled from the support portions 2*a*, due to the stands 21 being supported by the ground and the bucket 13 being supported by the ground. Accordingly, when coupling the front loader 10 to the travel vehicle body 1 later, it is possible to couple the coupling frames 11 to the support portions 2*a* without adjusting the posture-to-ground of the booms 12.

When the booms 12 are supported off the ground, the hydraulic pressure hose on the front loader side is separated from the hydraulic piping on the vehicle body side, whereby it is possible to move the travel vehicle body 1 with the front loader 10 still left on the ground.

When coupling the front loader 10 to the travel vehicle body 1, it is possible to operate the bucket 13, the booms 12, and the like in the reverse order of the above-described order of removing them from the travel vehicle body 1, without adjusting the posture-to-ground of the booms 12, to couple the front loader 10 to the travel vehicle body 1.

When the front loader 10 is supported by the ground, as shown in FIG. 4, the bending/stretching links 22 are in the propping and stretched state, and the link operating members 28 are supported on the stands 21 in a state in which the operation target surfaces 28*c* are located forward of the operation target surfaces 21*d* of the stands 21. Accordingly, when the coupling frames 11 are coupled to the support portions 2*a*, and then the stands 21 are raised and stored, the stand operating portions 26 of the bucket 13 first hit against the operation target surfaces 28*c* of the link operating members 28 to operate the link operating mechanisms 23 using the swing force of the bucket 13, and the bending/stretching links 22 in the propping and stretched state are operated to bend by the link operating mechanisms 23 so that the propping and stretched state is released. Then, the stand operating portions 26 of the bucket 13 hit against the operation target surfaces 21*d* of the stands 21, and the stands 21 start to be raised with the swing force of the bucket 13. Subsequently, the stands 21 are raised with the swing force of the bucket 13 into the raised/stored position while bending the bending/stretching links 22.

When the stands 21 are at the raised/stored position, the operation tool 33 is switched to the locked position L1. At this time, the lock portion 41*c* of the lock member 41 runs on the stopper 37, and the unlock operation tool 42 reaches the operation tool unlocking position K2, and thus it is possible to switch the operation tool 33 to the locked position L1, simply by operating the operation tool 33 using the grip arm 33*a* without operating the unlock operation tool 42.

When the operation tool 33 is switched to the locked position L1, the holding members 24 are switched to the holding posture, and engage with the hook portions 21*e* of the stands 21. When the operation tool 33 is switched to the locked position L1, the operation tool lock 40 is switched to the locking state by the spring 46, and the operation tool 33 is held at the locked position L1 by the operation tool lock 40. Accordingly, the holding members 24 are held in the holding posture, and it is possible to perform front loader operations while the holding members 24 holds the stands 21 at the raised/stored position.

In the front loader operations, when the booms 12 are raised and lowered so that the bucket 13 is raised and lowered, it is demanded that the bucket 13 can be raised and lowered while keeping a set posture-to-ground such as a scooping posture, without adjusting the extension and retraction operation of the bucket cylinders 19 together with the extension and retraction operation of the boom cylinders 16.

Figure 14:
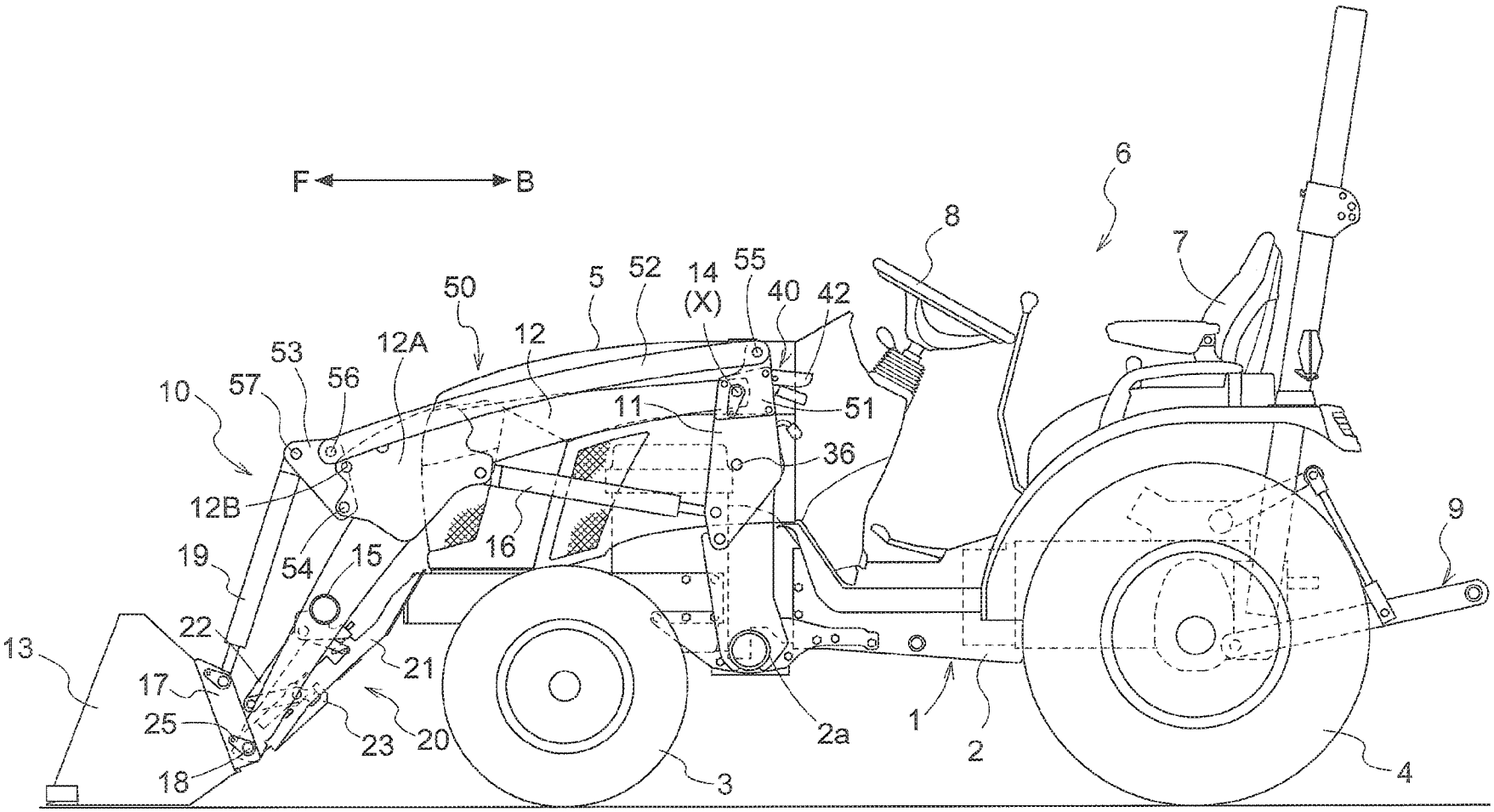
FIG. 14 is a left side view showing the tractor to which the front loader is coupled, and to which a removable posture keeping mechanism is coupled.

FIG. 14 is a left side view showing the tractor to which the front loader 10 and removable posture keeping mechanisms 50 are coupled.

As shown in FIG. 14, the posture keeping mechanisms 50 are respectively coupled to the left boom 12 and the right boom 12. The left posture keeping mechanism 50 and the right posture keeping mechanism 50 have the same configuration. The left and right posture keeping mechanisms 50 are each provided with a link stay 51, a pair of left and right posture keeping links 52, and a swing link 53.

As shown in FIG. 14, the link stay 51 is removably coupled to the upper portion of the coupling frame 11 with multiple connecting bolts. The link stay 51 has a support shaft hole through which the support shaft 14 is inserted at the position at which it is supported by the coupling frame 11. The swing link 53 is removably coupled to an intermediate portion 12A of the boom 12 via a support shaft 54. The swing link 53 is supported on the boom 12 so as to be swingable with the support shaft 54 used as the pivot point.

The pair of left and right posture keeping links 52 are respectively arranged inward, in the lateral direction of the vehicle body, of the link stay 51 and the swing link 53, and outward, in the lateral direction of the vehicle body, of the link stay 51 and the swing link 53. The rear end portions of the pair of left and right posture keeping links 52 are supported in the portion of the link stay 51 that is located above the support shaft 14 so as to be swingable via the support shaft 55. The front-end portions of the pair of left and right posture keeping links 52 are supported in the portion of the swing link 53 that is located above the support shaft 54 so as to be swingable via the support shaft 56.

The boom-side end portions of the bucket cylinders 19 are removed from the cylinder support portions 12B of the intermediate portions 12A of the booms 12, and are supported on the free end portions of the swing links 53 so as to be swingable via the support shafts 57.

When the booms 12 are raised and lowered, the swing links 53 are operated to swing by the posture keeping links 52 with the support shaft 54 used as the pivot point, and the swing force of the swing links 53 is transferred to the coupling brackets 17 of the bucket 13 via the bucket cylinders 19 so that the bucket 13 is operated to swing with respect to the booms 12 with the coupling shafts 18 used as the pivot points.

Accordingly, a posture-to-ground that the bucket 13 is to keep, such as the scooping posture, is set in advance, by adjusting the extension and retraction of the bucket cylinders 19. Accordingly, when the booms 12 are raised and lowered to raise and lower the bucket 13, the bucket 13 is raised and lowered while keeping the posture-to-ground set in advance using the posture keeping mechanisms 50, without performing posture adjustment of the bucket 13 to the booms 12 using extension and retraction adjustment of the posture of the bucket cylinders 19.

Other Embodiments (1) In the foregoing embodiment, the operation portions (stand operating portions 26) for causing the link operating members 28 to slide are arranged on the bucket 13, but the operation portions may be arranged and implemented on a component other than the bucket 13.

(2) In the foregoing embodiment, the stands 21 are provided inward, in the lateral direction of the vehicle body, of the booms 12, but may also be provided outward, in the lateral direction of the vehicle body, of the booms 12.

(3) In the foregoing embodiment, each of the link operating members 28 is provided between the left and right longitudinal plate portions 21A of the stand 21, but may also be provided outside the stand 21, for example, laterally outside the stand 21.

(4) In the foregoing embodiment, the stand operating portions 26 for pressing the stands 21 serve as the pressing operation pins for pressing the link operating members 28. Depending on the arrangement of the link operating members 28, however, the stand operating portions 26 and the pressing operation pins may be separate members by providing the link operating members 28 outside the stands 21, for example.

(5) In the foregoing embodiment, the holding members 24 and the operation tool 33 are operably coupled to each other via the wires 35, but a configuration can also be employed in which they are operably coupled to each other via a link, an interlocking rod, or the like.

(6) In the foregoing embodiment, the operation tool 33 is supported by the left coupling frame 11, but the operation tool 33 may be supported by the right coupling frame 11 instead. Furthermore, a configuration can also be employed in which the operation tool 33 is supported on any portion of the front loader 10 other than the coupling frames 11.

(7) In the foregoing embodiment, the unlock operation tool 42 may be gripped together with the operation portion 33*a* of the operation tool 33. Instead thereof, the unlock operation tool 42 may be provided on the operation portion 33*a* so that the unlock operation tool 42 is operable by a finger of the hand that supports the operation portion 33*a*.

(8) In the foregoing embodiment, the common operation tool 33 is used for the operation of changing the posture of the holding member 24 of the left stand unit 20 and for the operation of changing the posture of the holding member 24 of the right stand unit 20. Instead thereof, an operation tool for changing the posture of the holding member 24 of the left stand unit 20 and an operation tool for changing the posture of the holding member 24 of the right stand unit 20 may be provided and implemented separately.

(9) The present invention is applicable to not only front loaders that are coupled to tractors but also front loaders that are coupled to various types of vehicles, such as a front loader operation-dedicated vehicle.

The invention claimed is:

1. A front loader comprising:

a coupling frame configured to be removably coupled to a vehicle body;

a boom supported by the coupling frame to be pivotable up/down relative to the coupling frame;

a bucket supported at a front end of the boom to be pivotable up/down relative to the boom; and a posture keeping mechanism configured to keep a posture-to-ground of the bucket when the boom is pivoted up/down relative to the coupling frame, the posture keeping mechanism being configured to be removably coupled to the coupling frame;

wherein the posture keeping mechanism includes:

a link stay configured to be removably coupled to an upper portion of the coupling frame;

a posture keeping link having a rear end thereof coupled to the link stay; and a swing link pivotably supported by the boom at an intermediate portion of the boom, a forward end of the posture keeping link being pivotably supported by the swing link; and wherein a link support shaft extends through the link stay in a lateral direction of the vehicle body, and the rear end of the posture keeping link is pivotably supported by the link stay via the link support shaft.

2. The front loader according to claim 1, further comprising:

a first support shaft, the boom being configured to be coupled to the coupling frame to be pivotable about the first support shaft;

wherein the link stay has a support shaft hole through which the first support shaft is inserted when the link stay is coupled to the coupling frame.

3. The front loader according to claim 2, wherein the support shaft extends through the link stay at a level higher than the first support shaft.

4. The front loader according to claim 1, further comprising:

a second support shaft;

wherein the swing link is configured to be pivotable about the second support shaft relative to the intermediate portion of the boom; and the swing link is configured to be removably coupled to the intermediate portion of the boom via the second support shaft.

5. The front loader according to claim 1, wherein the link stay is removably coupled to the coupling frame via a plurality of connecting bolts.

6. The front loader according to claim 1, wherein the posture keeping link includes an inner posture keeping link arranged inward of the link stay and the swing link in the lateral direction of the vehicle body, and an outer posture keeping link arranged outward of the link stay and the swing link in the lateral direction of the vehicle body.

7. A posture keeping mechanism configured to keep a posture-to-ground of a bucket, the mechanism comprising:

a link stay configured to be removably coupled to a coupling frame of a front loader;

a posture keeping link having a rear end thereof coupled to the link stay; and a swing link pivotably supported by a boom of the front loader at an intermediate portion of the boom, a forward end of the posture keeping link being pivotably supported by the swing link; and wherein a link support shaft extends through the link stay in a lateral direction of the front loader; and the rear end of the posture keeping link is pivotably supported by the link stay via the link support shaft.

8. The posture keeping mechanism according to claim 7, wherein the link stay is removably coupled to the coupling frame via a plurality of connecting bolts.

9. The posture keeping mechanism according to claim 7, wherein the posture keeping link includes an inner posture keeping link arranged inward of the link stay and the swing link in the lateral direction of the front loader, and an outer posture keeping link arranged outward of the link stay and the swing link in the lateral direction of the front loader.

10. A front loader comprising:

a coupling frame configured to be removably coupled to a vehicle body;

a boom supported by the coupling frame to be pivotable up/down relative to the coupling frame;

a bucket supported at a front end of the boom to be pivotable up/down relative to the boom; and a posture keeping mechanism configured to keep a posture-to-ground of the bucket;

wherein in each of the coupling frame and an intermediate portion of the boom, there is formed a mounting hole through which the posture keeping mechanism is configured to be attached thereto;

wherein the posture keeping mechanism includes:

a link stay configured to be removably coupled to an upper portion of the coupling frame;

a posture keeping link having a rear end thereof coupled to the link stay; and a swing link pivotably supported by the boom at an intermediate portion of the boom, a forward end of the posture keeping link being pivotably supported by the swing link; and wherein the coupling frame has an upper face thereof configured to removably support the link stay; and wherein a link support shaft extends through the link stay in a lateral direction of the vehicle body; and the rear end of the posture keeping link is pivotably supported by the link stay via the link support shaft.

11. The front loader according to claim 10, wherein the link stay is removably coupled to the coupling frame via a plurality of connecting bolts.

12. The front loader according to claim 10, wherein the posture keeping link includes an inner posture keeping link arranged inward of the link stay and the swing link in the lateral direction of the vehicle body, and an outer posture keeping link arranged outward of the link stay and the swing link in the lateral direction of the vehicle body.

13. A front loader comprising:

a coupling frame configured to be removably coupled to a vehicle body;

a boom supported by the coupling frame to be pivotable up/down relative to the coupling frame;

a bucket supported at a front end of the boom to be pivotable up/down relative to the boom; and a posture keeping mechanism configured to keep a posture-to-ground of the bucket when the boom is pivoted up/down relative to the coupling frame, the posture keeping mechanism being configured to be removably coupled to the coupling frame;

wherein the posture keeping mechanism includes:

a link stay configured to be removably coupled to an upper portion of the coupling frame;

a posture keeping link having a rear end thereof pivotably supported by the link stay; and a swing link pivotably supported by the boom at an intermediate portion of the boom, a forward end of the posture keeping link being pivotably supported by the swing link, wherein the front loader further comprises a first support shaft, the boom being configured to be coupled to the coupling frame to be pivotable about the first support shaft; and wherein the link stay has a support shaft hole through which the first support shaft is inserted when the link stay is coupled to the coupling frame.

14. The front loader according to claim 13, further comprising:

a second support shaft;

wherein the swing link is configured to be pivotable about the second support shaft relative to the intermediate portion of the boom; and the swing link is configured to be removably coupled to the intermediate portion of the boom via the second support shaft.

* * * * *